US011346036B2

(12) United States Patent
Mora et al.

(10) Patent No.: US 11,346,036 B2
(45) Date of Patent: May 31, 2022

(54) DOOR ASSEMBLY FOR A WASHING MACHINE APPLIANCE

(71) Applicant: Haier US Appliance Solutions, Inc., Wilmington, DE (US)

(72) Inventors: Adam Raymond Mora, La Grange, KY (US); Venkata Chakradhar Rangu, Hyderabad (IN)

(73) Assignee: Haler US Appliance Solutions, Inc., Wilmington, DE (US)

( * ) Notice: Subject to any disclaimer, the term of this patent is extended or adjusted under 35 U.S.C. 154(b) by 69 days.

(21) Appl. No.: 16/701,520

(22) Filed: Dec. 3, 2019

(65) Prior Publication Data

US 2021/0164147 A1 Jun. 3, 2021

(51) Int. Cl.
*D06F 37/28* (2006.01)
*D06F 21/04* (2006.01)
*D06F 39/14* (2006.01)

(52) U.S. Cl.
CPC ..... *D06F 37/28* (2013.01); *D06F 21/04* (2013.01); *D06F 39/14* (2013.01)

(58) Field of Classification Search
CPC ..... D06F 21/04; D06F 37/28; D06F 39/14
See application file for complete search history.

(56) References Cited

U.S. PATENT DOCUMENTS 6,966,204 B2 11/2005 Bollmann
7,559,156 B2 * 7/2009 Renzo ..... D06F 58/04 34/595
8,127,464 B2 3/2012 Schoene
8,162,418 B2 4/2012 Kocak et al.
10,253,441 B2 4/2019 Anand et al.
2005/0262681 A1 * 12/2005 Yoon ..... D06F 39/14 29/428
2006/0110236 A1 * 5/2006 Poloni ..... D06F 37/265 411/386
2007/0125132 A1 * 6/2007 Hwang ..... D06F 39/14 68/3 R
2011/0025178 A1 * 2/2011 Schone ..... D06F 39/14 312/228
2012/0043833 A1 * 2/2012 Lee ..... D06F 37/30 310/43
2015/0008807 A1 * 1/2015 Kim ..... D06F 37/28 312/228
2015/0176190 A1 * 6/2015 Kim ..... F16F 9/003 312/245
2016/0296865 A1 * 10/2016 Blanks ..... B01D 29/17
2018/0135222 A1 * 5/2018 Lee ..... D06F 37/262
2019/0161904 A1 * 5/2019 Nam ..... E05B 9/02
2019/0161905 A1 * 5/2019 Nam ..... D06F 39/14

FOREIGN PATENT DOCUMENTS

EP 2732088 B1 8/2015

* cited by examiner

*Primary Examiner* — Joseph L. Perrin
(74) *Attorney, Agent, or Firm* — Dority & Manning, P.A.

(57) ABSTRACT

A door assembly for a washing machine appliance includes an outer door frame, an inner door frame, and two reinforcement brackets positioned between the outer door frame and the inner door frame on opposite sides of the door assembly. The outer door frame defines a boss and the reinforcement bracket defines an expandable sleeve received within the boss. A mechanical fastener passes through the inner door frame and into the expandable sleeve to increase a diameter of the expandable sleeve to engage the boss and join the inner door frame, the reinforcement brackets, and the outer door frame.

14 Claims, 11 Drawing Sheets

DOOR ASSEMBLY FOR A WASHING MACHINE APPLIANCE

FIELD OF THE INVENTION

The present subject matter relates generally to washing machine appliances, or more specifically, to door assemblies for washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances includes a door that is rotatably mounted over an access opening in the tub to seal and provide selective access to the wash chamber. Such doors typically include a glass window sandwiched between an inner and outer frame, as well as one or more hinge support brackets for mounting the door to the front panel of the washing machine appliance. However, fastening these various components together within the limited space inside the door is often difficult or requires highly visible fasteners. Furthermore, conventional means of assembling these door assemblies results in insufficiently rigid doors, a complex assembly process, increased costs, and a lack of versatility for interchanging a hinge bracket and handle bracket.

Accordingly, a washing machine appliance having an improved door assembly would be desirable. More particularly, a door assembly for a washing machine appliance including an easy to assembly, rigid, and durable door assembly would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a cabinet including a front panel defining an opening, a wash tub positioned within the cabinet, a wash basket rotatably mounted within the wash tub and defining a wash chamber for receiving a load of articles for washing, and a door assembly rotatably mounted to the cabinet for providing selective access to the wash chamber through the opening. The door assembly includes an outer door frame defining a boss, a reinforcement bracket defining an expandable sleeve received within the boss, and a mechanical fastener that passes through the expandable sleeve to increase a diameter of the expandable sleeve to engage the boss and secure the reinforcement bracket to the outer door frame.

In accordance with another exemplary embodiment of the present disclosure, a door assembly rotatably providing selective access to a wash chamber of a washing machine appliance is provided. The door assembly includes an outer door frame defining a boss, an inner door frame defining an aperture, a reinforcement bracket positioned between outer door frame and the inner door frame, the reinforcement bracket defining an expandable sleeve received within the boss, and a mechanical fastener that passes through the aperture in the inner door frame and into the expandable sleeve to increase a diameter of the expandable sleeve to engage the boss and join the inner door frame, the reinforcement bracket, and the outer door frame.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
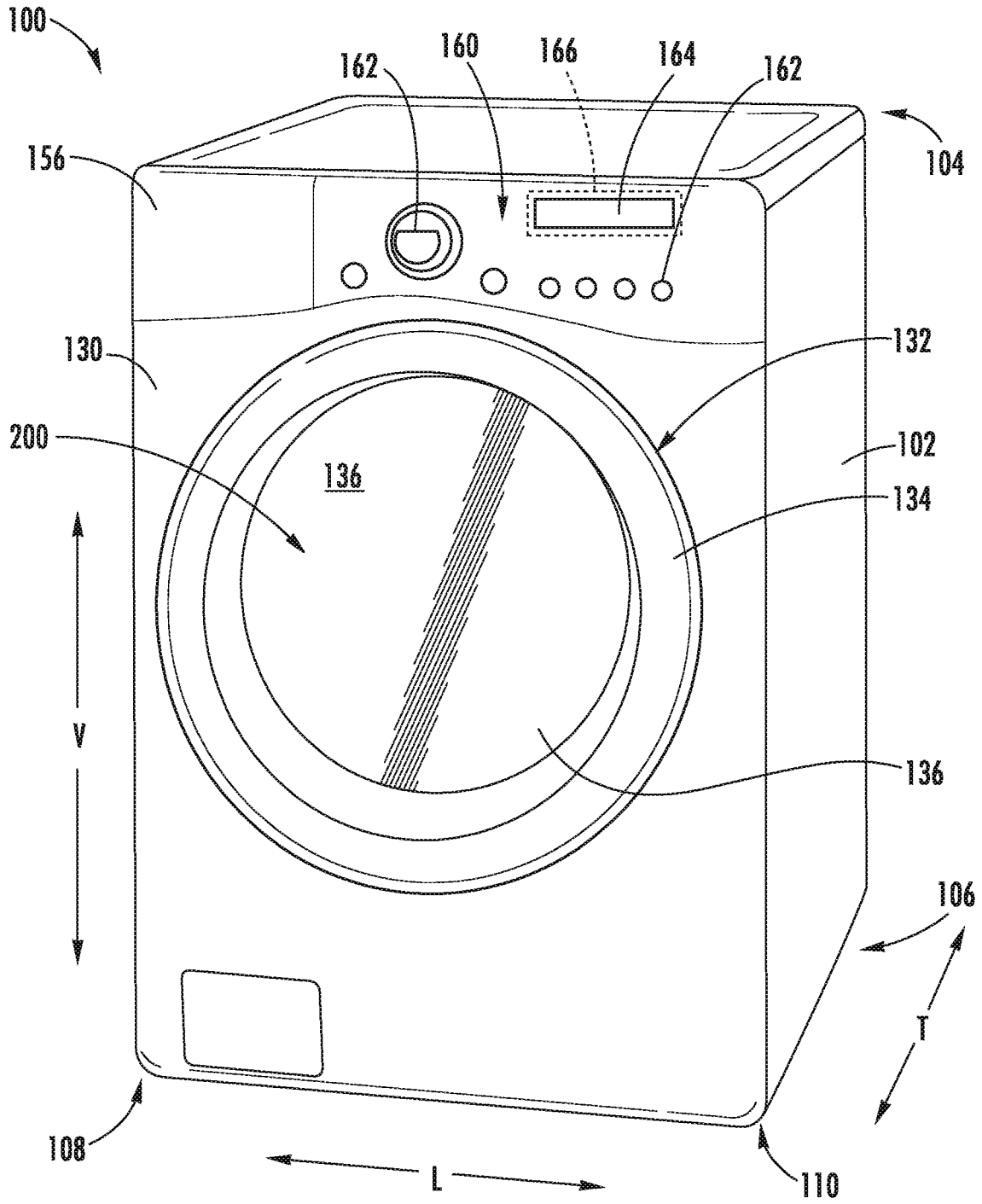
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
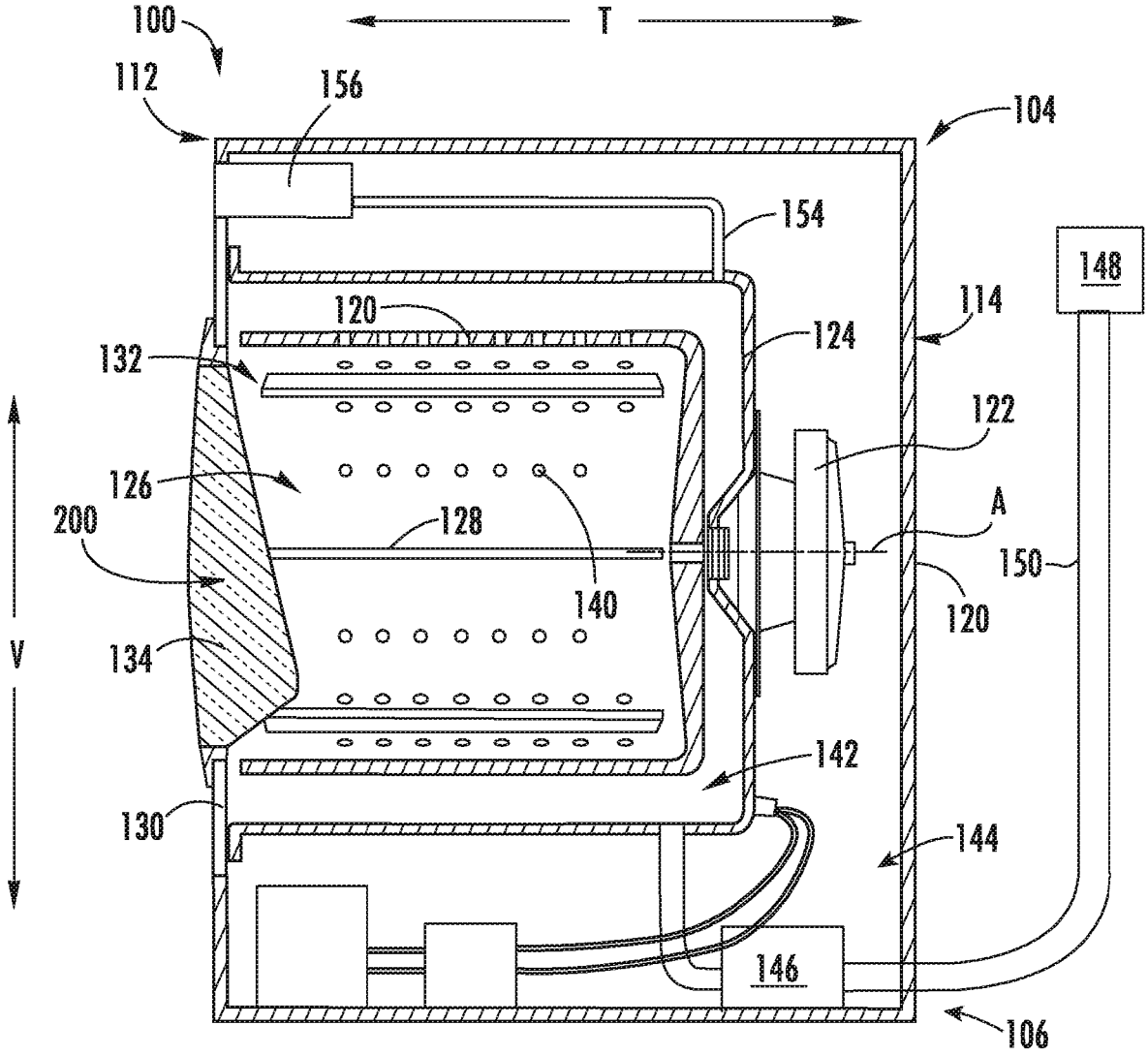
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148. Notably, external drain 148 is typically positioned above drain pump 146 along the vertical direction V. Therefore, wash fluid that is pumped out of sump 142 but which does not reach external drain 148 has a tendency to fall under the force of gravity back into sump 142 when drain pump 146 stops operating.

A spout 154 is configured for directing a flow of fluid into wash tub 124. For example, spout 154 may be in fluid communication with a water supply (not shown) in order to direct fluid (e.g., clean water) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 156 may also be fluidly coupled to spout 154 to facilitate the complete and accurate dispensing of wash additive.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (not shown) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring now generally to FIGS. 3 through 11, a door assembly 200 that may be used with washing machine appliance 100 will be described according to exemplary embodiments of the present subject matter. In general, door assembly 200 may replace door 134 of washing machine appliance 100 or may be used to provide selective access to the interior of any other suitable appliance. For example, door assembly 200 could alternatively be used for a top load washing machine appliance, a microwave appliance, an oven appliance, etc. In addition, although one exemplary configuration of door assembly 200 is described herein, it should be appreciated that variations and modifications may be made to door assembly 200 while remaining within the scope of the present subject matter.

Figure 3:
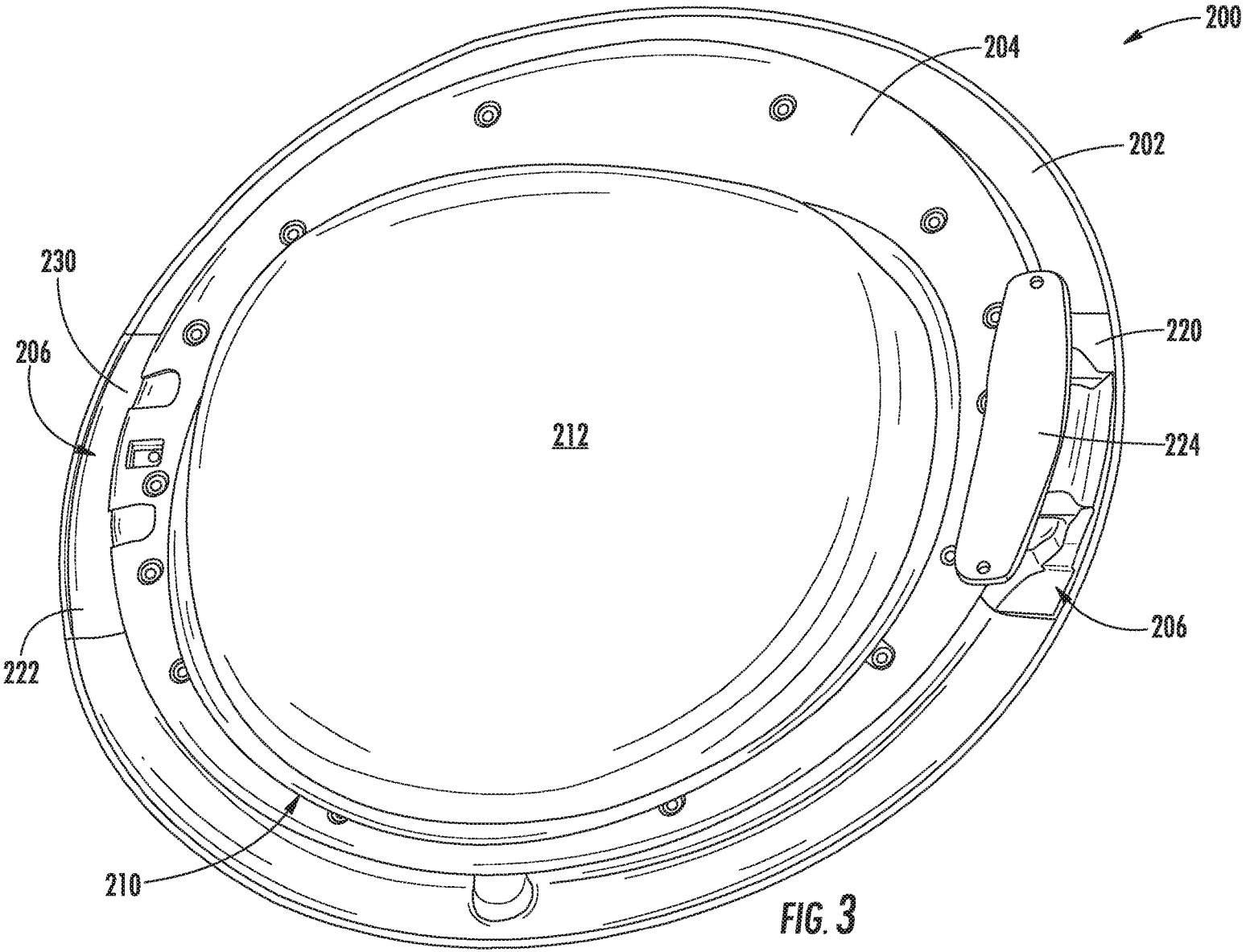
FIG. 3 provides a rear, perspective view of a door assembly for use with the exemplary washing machine appliance of FIG. 1 according to an exemplary embodiment of the present subject matter.
Figure 4:
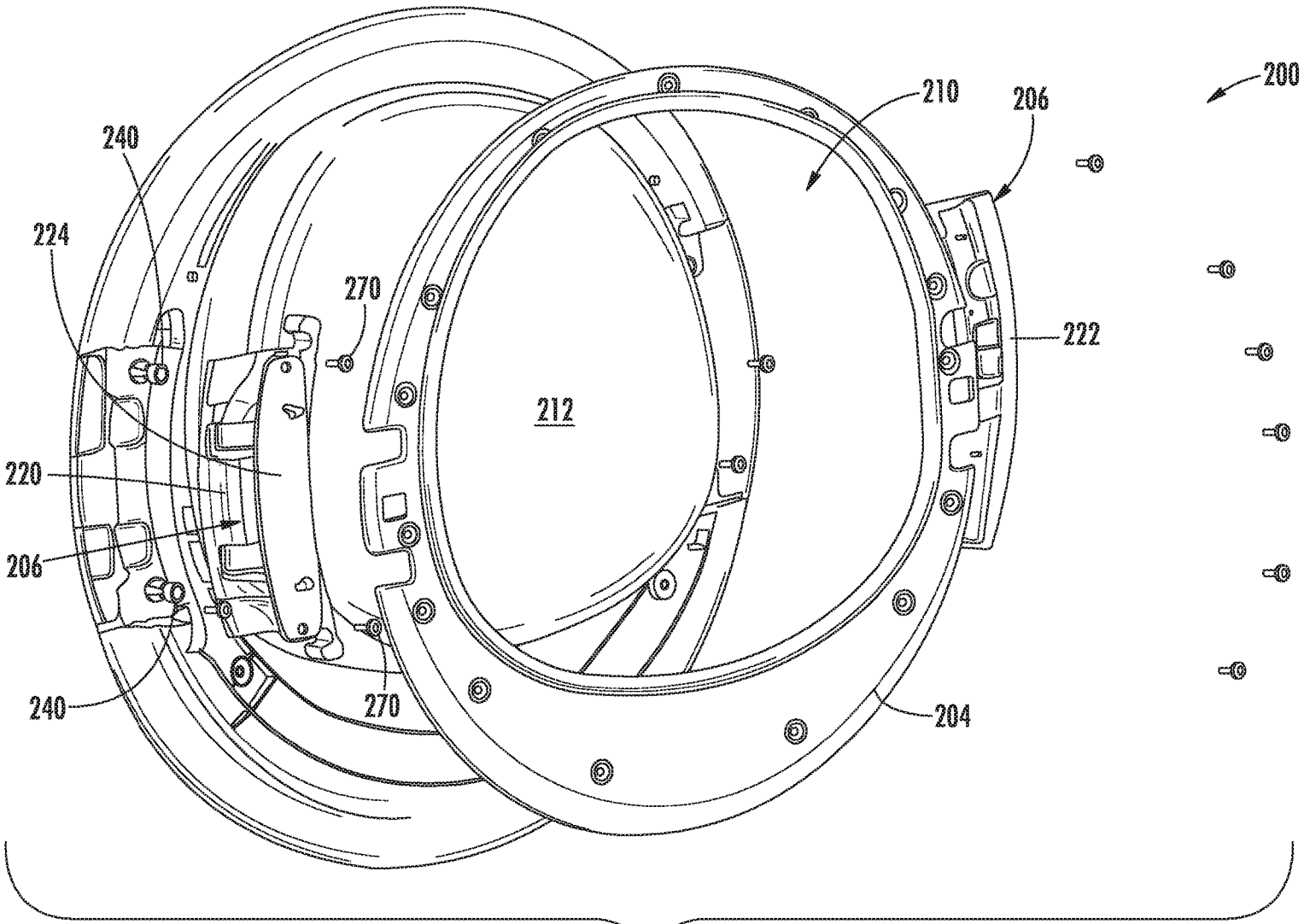
FIG. 4 provides an exploded view of the exemplary door assembly of FIG. 3 according to an exemplary embodiment of the present subject matter.

As best shown in FIGS. 3 and 4, door assembly 200 generally includes an outer door frame 202, an inner door frame 204, and one or more reinforcement brackets 206 that are joined together to form a rigid assembly that is mountable over an opening defined in front panel 130. Specifically, outer door frame 202 and inner door frame 204 may be substantially circular or annular members that together define a central opening 210. According to exemplary embodiments, a window 212 (e.g., similar to window 136) may be positioned within central opening 210 and may be sandwiched between outer door frame 202 and inner door frame 204.

As shown, reinforcement brackets 206 are positioned between outer door frame 202 and inner door frame 204. More specifically, door assembly 200 includes two reinforcement brackets 206 that are generally configured for joining outer door frame 202 and inner door frame 204 while providing improved rigidity. In addition, reinforcement brackets 206 may perform additional functions or purposes for door assembly 200. For example, according to the illustrated embodiment, one of the reinforcement brackets 206 is a hinge bracket 220, while the other reinforcement bracket 206 is a handle frame 222. As shown, hinge bracket 220 and handle frame 222 are positioned on opposite lateral sides of door assembly 200. However, according to alternative embodiments, door assembly 200 may include any other suitable number, type, and position of reinforcement brackets 206.

In general, as best shown in FIGS. 3, 4, 6, and 8, hinge bracket 220 is mounted on one side of door assembly 200 and is generally configured for receiving a door hinge 224. In this regard, door hinge 224 may be mounted to cabinet 102 or front panel 130 of washing machine appliance 100. In this regard, bracket 220 may be a structurally rigid and reinforced member that includes features for engaging such a door hinge 224. For example, hinge bracket 220 and door hinge 224 may be joined by a hinge pin 226 (see FIGS. 6 and 8). When assembled and installed, door assembly 200 may pivot about hinge pin 226, e.g., about a vertical pivot axis.

Figure 5:
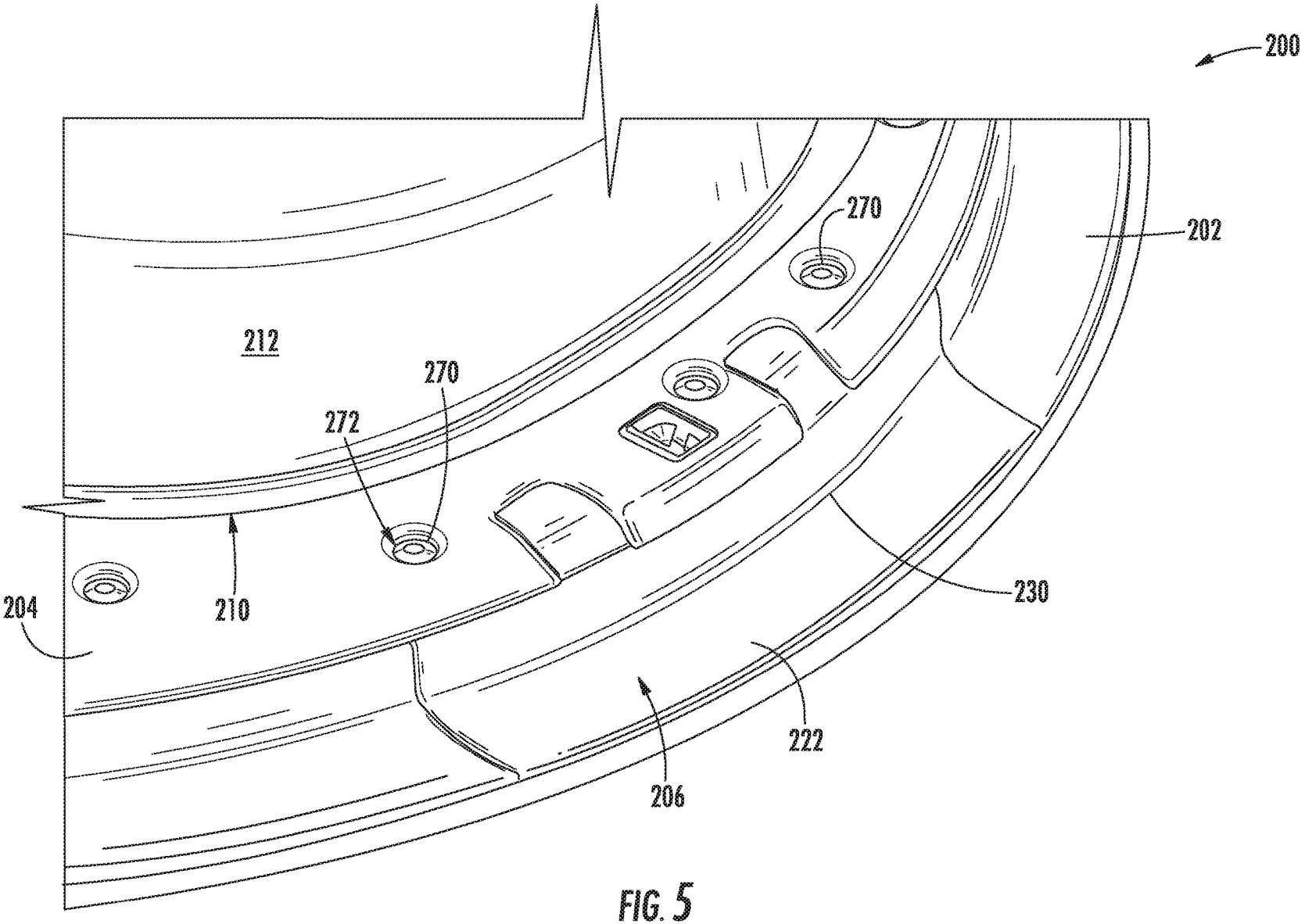
FIG. 5 provides a perspective view of a handle frame of the exemplary door assembly of FIG. 3 according to an exemplary embodiment of the present subject matter.
Figure 6:
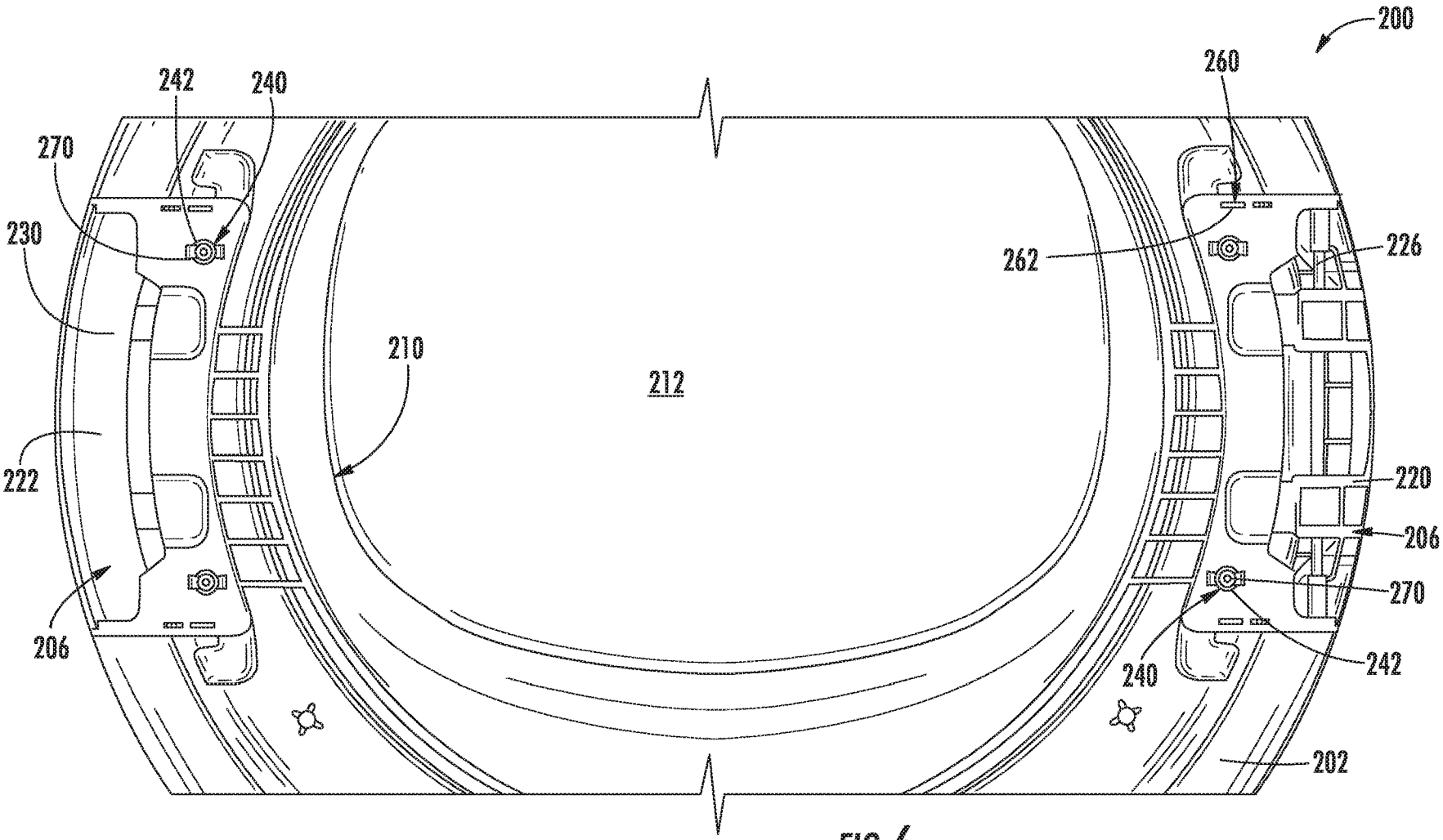
FIG. 6 provides a perspective view of the exemplary door assembly of FIG. 3 according to an exemplary embodiment of the present subject matter.
Figure 7:
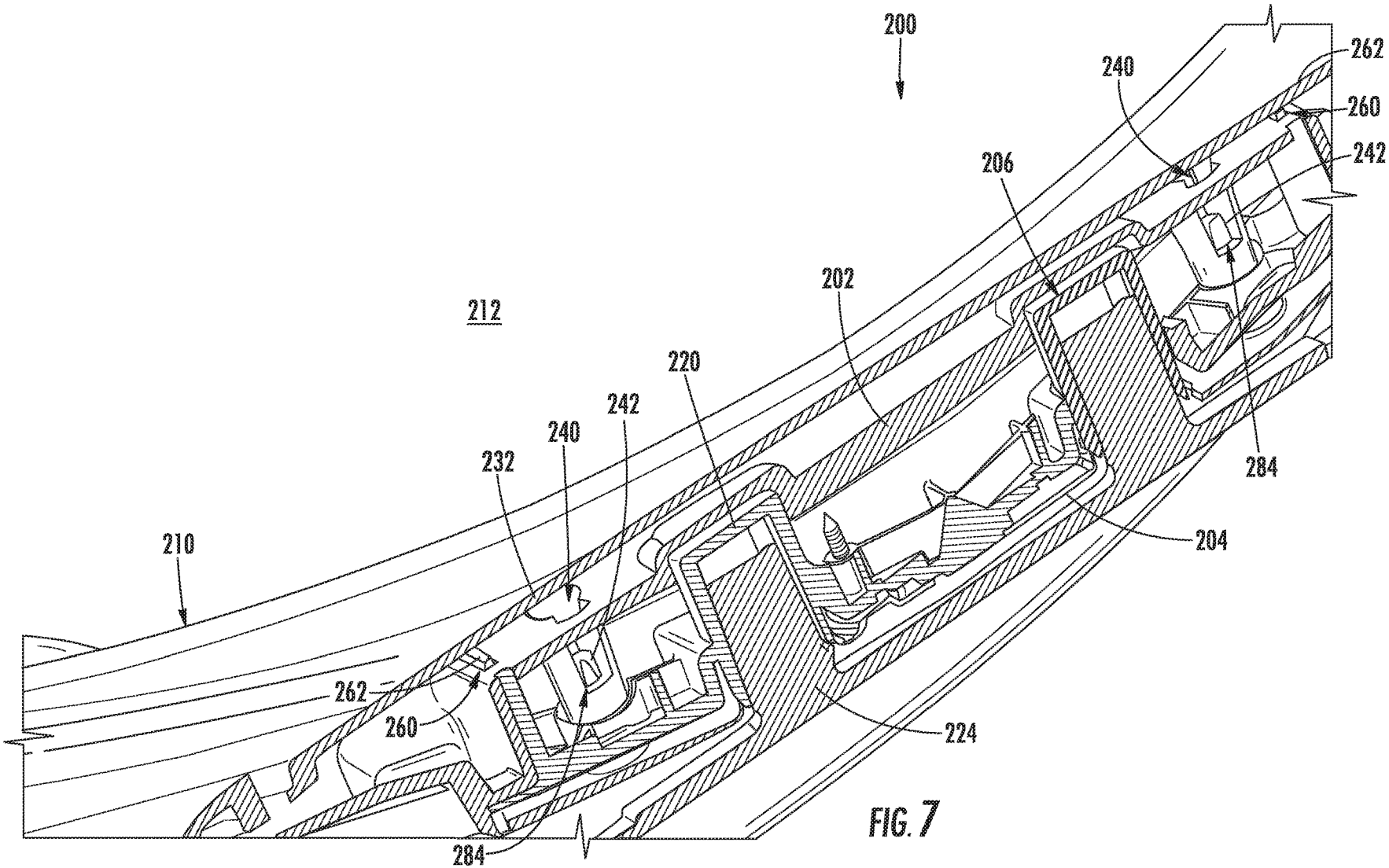
FIG. 7 provides a cross-sectional view of the exemplary door assembly of FIG. 3 according to an exemplary embodiment of the present subject matter.

As best shown in FIGS. 3 through 5, handle frame 222 may be a reinforcement bracket 206 that is positioned on the opposite lateral side of door assembly 200 and defines a grip 230, e.g., for permitting a user to grasp and open door assembly 200. Notably, according to exemplary embodiments the present subject matter, reinforcement brackets 206 are symmetrical, such that the attachment features (as described below) are positioned at identical locations on both the hinge bracket 220 and handle frame 222. In this manner, these reinforcement brackets 206 are interchangeable and may be used in either position, e.g., to facilitate doors that pivot on the left side and doors that pivot on the right side.

In general, outer door frame 202, inner door frame 204, and reinforcement brackets 206 may be formed from any suitably rigid material that facilitates the construction of a strong, sturdy, and durable door assembly 200 that may be repeatedly opened and closed to facilitate repeated access to wash chamber 126. For example, according to an exemplary embodiment, reinforcement brackets 206 may be formed by injection molding, e.g., using a suitable plastic material, such as polypropylene, injection molding grade high impact polystyrene (HIPS) or acrylonitrile butadiene styrene (ABS). Alternatively, according to the exemplary embodiment, these components may be compression molded, e.g., using sheet molding compound (SMC) thermoset plastic or other thermoplastics. In addition, it may be desirable to include fiberglass reinforcement or another suitable reinforcing material within hinge bracket 220, e.g., to support the excessive loading experienced at door hinge 224. For example, handle frame 222 may be 100% polypropylene and hinge bracket 220 may be 60% polypropylene and 40% fiberglass. According still other embodiments, the various components of door assembly 200 may be formed from metal or any other suitable rigid material, such as sheet metal.

Figure 8:
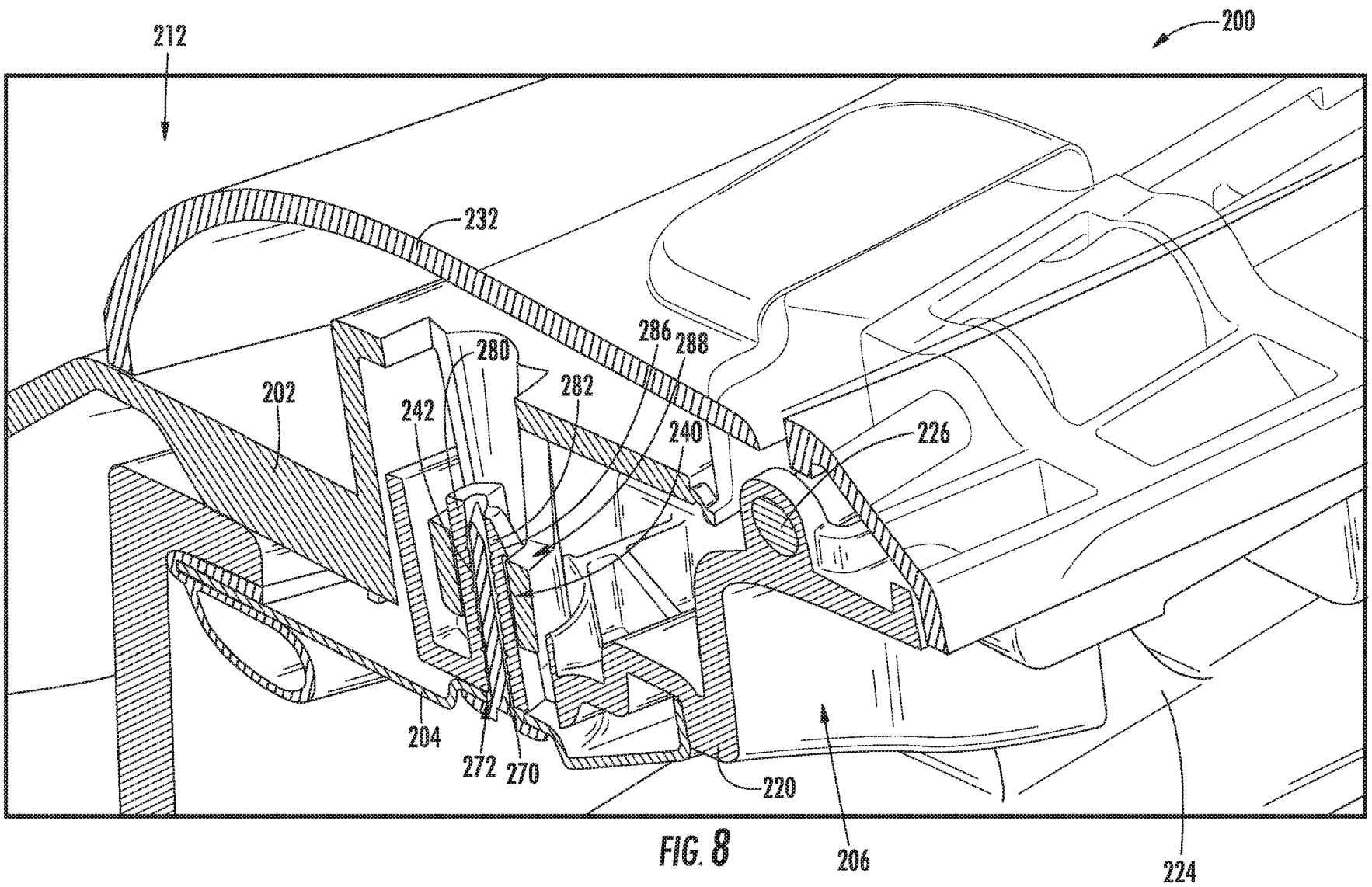
FIG. 8 provides another cross-sectional view of the exemplary door assembly of FIG. 3 according to an exemplary embodiment of the present subject matter.

Door assembly 200 may further include additional components that are used to improve the style or appearance of door assembly 200. For example, as best shown in FIG. 8, door assembly 200 may include an appearance piece 232 that is positioned on and secured to outer door frame 202, e.g., to conceal reinforcement brackets 206 and provide a clean look to the outer side of door assembly 200. According to exemplary embodiments, a similar appearance piece may be mounted to inner door frame 204 along with one or more gaskets or sealing elements to facilitate an improved seal with front panel 130 of washing machine appliance 100.

Notably, aspects of the present subject matter are directed towards a convenient and secure means for securing outer door frame 202, inner door frame 204, and reinforcement brackets 206 to form the complete door assembly 200. In this regard, referring still generally to FIGS. 3 through 11, outer door frame 202 may define one or more bosses 240 and reinforcement brackets 206 may define expandable sleeves 242, each of the expandable sleeves 242 being configured for receipt within one of the bosses 240. More specifically, according to the illustrated embodiment, outer door frame 202 defines four bosses 240, e.g., two positioned on each lateral side of outer door frame 202. In addition, hinge bracket 220 and handle frame 222 each define two expandable sleeves 242 for receipt within such bosses 240. Notably, as explained above, the bosses 240 and expandable sleeves 242 are positioned symmetrically such that hinge bracket 220 and handle frame 222 are interchangeable.

Figure 9:
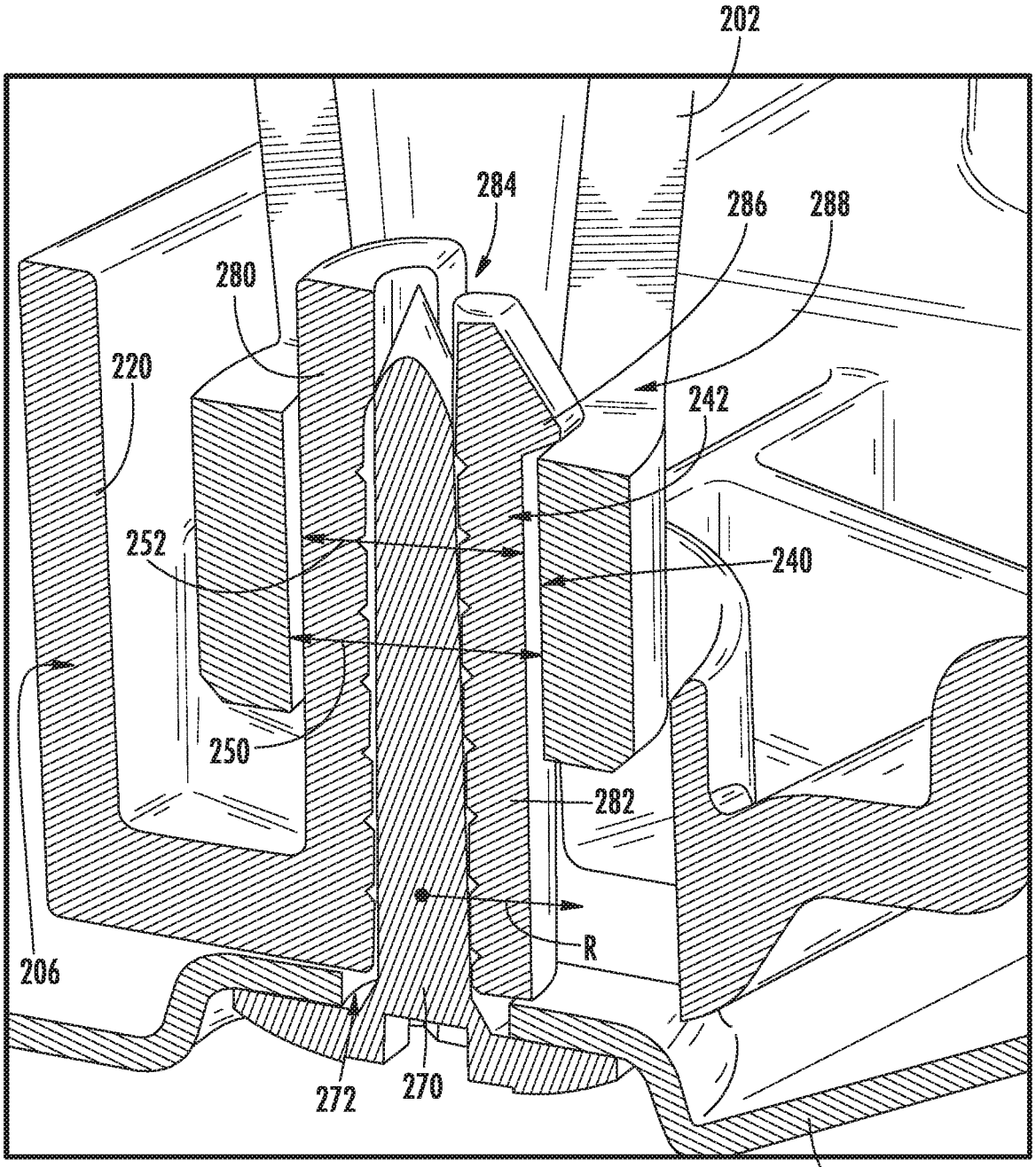
FIG. 9 provides a cross-sectional view of an expandable sleeve and boss of the exemplary door assembly of FIG. 3 according to an exemplary embodiment of the present subject matter.
Figure 10:
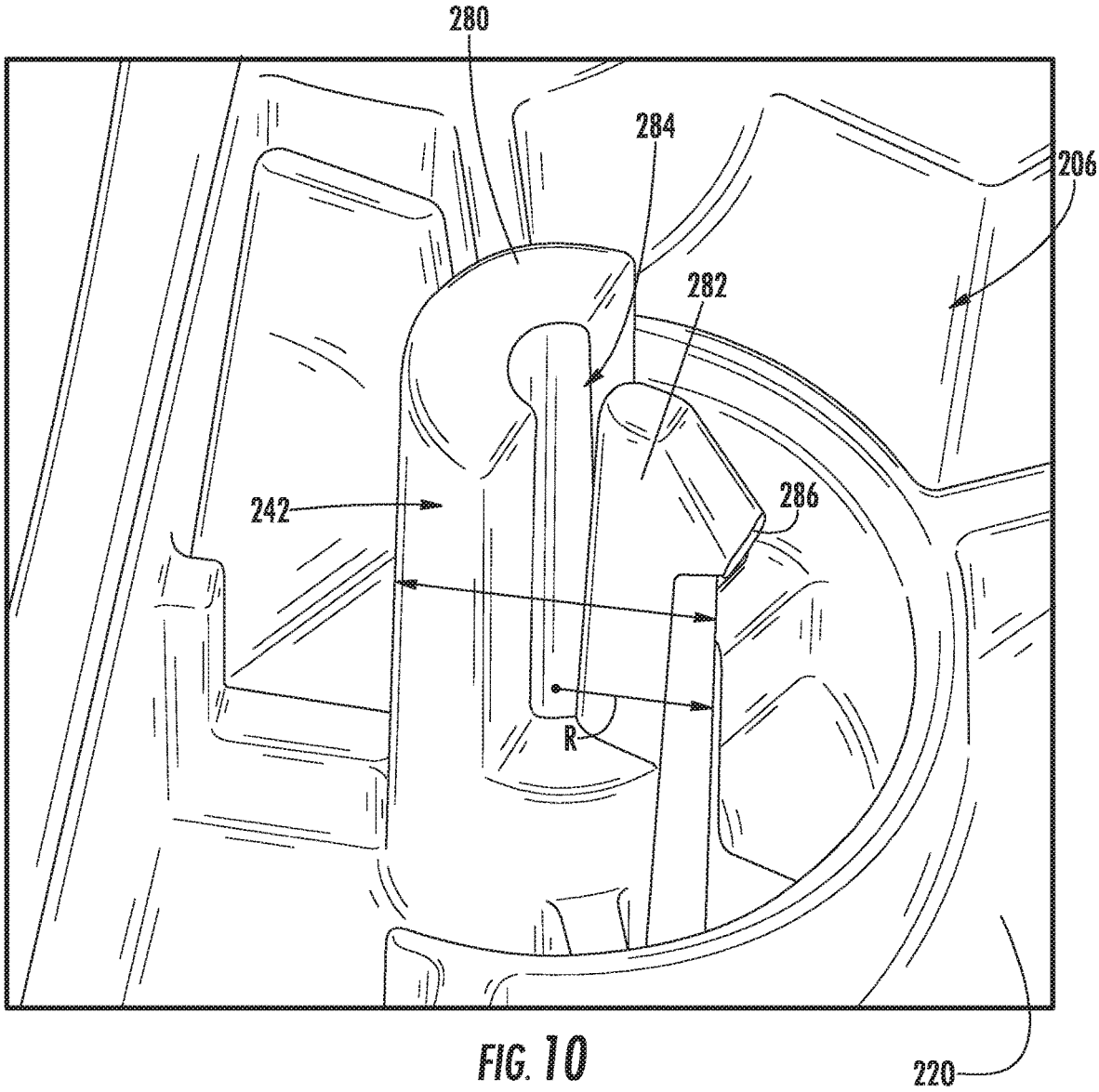
FIG. 10 provides a perspective view of the exemplary expandable sleeve of FIG. 9 according to an exemplary embodiment of the present subject matter.
Figure 11:
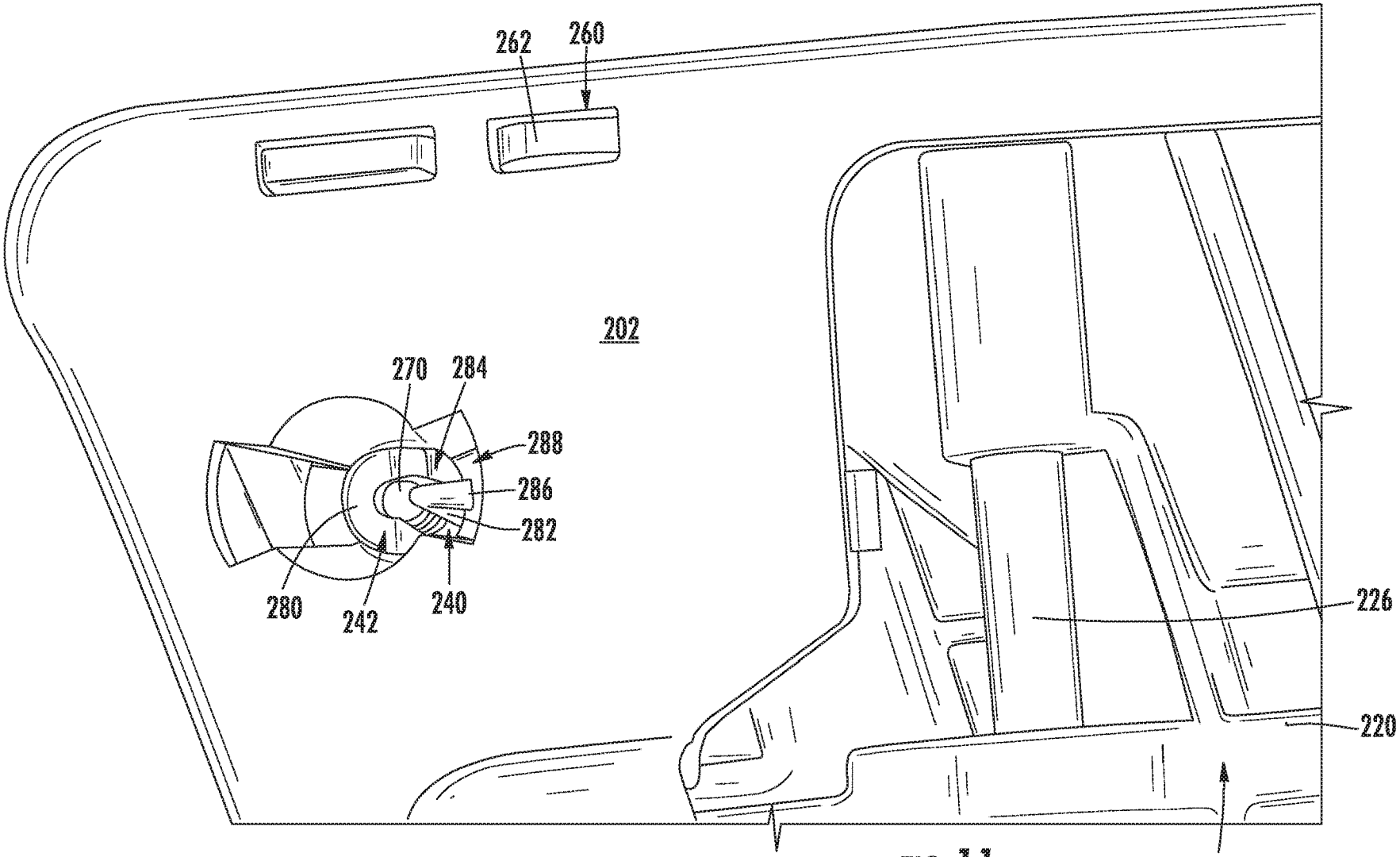
FIG. 11 provides a perspective view of the exemplary door assembly of FIG. 3 according to an exemplary embodiment of the present subject matter.

Notably, according to an exemplary embodiment, each boss 240 defines an inner diameter 250 (see, e.g., FIG. 9) and expandable sleeves 242 each define an outer diameter 252 (see, e.g., FIG. 9). For clarity, expandable sleeve 242 is not shown in the expanded position in FIG. 9. According to an exemplary embodiment, inner diameter 250 of bosses 240 may be substantially equal to or slightly larger than outer diameter 252 of expandable sleeves 242. In this manner, during assembly of door assembly 200, a technician may quickly and easily slide reinforcement brackets 206 into outer door frame 202. It should be appreciated that as used herein, terms of approximation, such as "approximately," "substantially," or "about," refer to being within a ten percent margin of error.

Notably, according to exemplary embodiments, door assembly 200 may include additional features for facilitating improved alignment and assembly. For example, referring briefly to FIGS. 7 and 11, outer door frame 202 may define one or more alignment apertures 260 and reinforcement bracket 206 may define corresponding alignment features 262 for receipt within the alignment apertures 260. In this manner, and operator may quickly and easily position and properly align reinforcement brackets 206 with an outer door frame 202 during the assembly process. It should be appreciated that the size, position, and geometry of alignment apertures 260 and alignment features 262 may vary while remaining within the scope of the present subject matter.

As best shown in FIGS. 8 and 9, door assembly 200 may further include a plurality of mechanical fasteners 270, each of which is generally configured for passing through expandable sleeves 242 to increase the diameter of expandable sleeves 242 to engage the bosses 240 and secure reinforcement brackets 206 within outer door frame 202. In addition, according to the illustrated embodiment, inner door frame 204 is positioned adjacent reinforcement brackets 206 opposite outer door frame 202 and defines an aperture 272 through which fastener 270 may pass to join outer door frame 202, inner door frame 204, and reinforcement brackets 206. According to the illustrated embodiment, mechanical fastener 270 is a self-threading screw received within expandable sleeves 242. However, according to alternative embodiments, expandable sleeve 242 may define a threaded interior surface for receipt of a threaded screw. According to the illustrated embodiment, each of the bosses 240, the expandable sleeve 242, and the mechanical fasteners 270 all extend substantially along the transverse direction T when door assembly 200 is assembled and installed in the closed position on washing machine appliance 100.

Notably, expandable sleeves 242 may generally engage bosses 240 in a manner similar to a drywall anchor. In this regard, expandable sleeves 242 may include a first portion 280 that is spaced apart from a second portion 282 by a gap 284. As mechanical faster 270 advances through expandable sleeve 242, the first portion 280 and the second portion 282 are forced to deflect away from each other, such that the size or diameter of expandable sleeve 242 is increased, thereby pressing into the walls that define bosses 240 providing secure frictional and mechanical engagement. Thus, when mechanical fastener 270 is properly installed, reinforcement brackets 260 are secured to the outer door frame 202. According to still other embodiments, door assembly 200 may include additional features for improving the engagement or secure relationship between reinforcement brackets 206 and outer door frame 202.

In this regard, as best illustrated in FIGS. 7 through 11, reinforcement brackets 206 may further define a protrusion 286 that extends outward along a radial direction R from each expandable sleeve 242. In addition, each of the bosses 240 may define a complementary slot 288 for receiving the protrusion to secure reinforcement bracket 206 to outer door frame 202. Although protrusion 286 is illustrated as being a small radially-extending flag or bump extending from an outer surface of second portion 282, it should be appreciated that according to alternative embodiments, protrusion 286 and complementary slot 288 may have any other suitable size, dimension, or positions that facilitate improved engagement between expandable sleeve 242 and boss 240.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a front panel defining an opening;

a wash tub positioned within the cabinet;

a wash basket rotatably mounted within the wash tub and defining a wash chamber for receiving a load of articles for washing; and a door assembly rotatably mounted to the cabinet for providing selective access to the wash chamber through the opening, the door assembly comprising:

an outer door frame defining a boss and an inner face that faces the wash tub when the door assembly is in a closed position;

a reinforcement bracket seated on the inner face of the outer door frame and defining an expandable sleeve received within the boss;

a mechanical fastener that passes through the expandable sleeve to increase a diameter of the expandable sleeve to engage the boss and secure the reinforcement bracket to the outer door frame; and an inner door frame positioned adjacent the reinforcement bracket opposite the outer door frame such that the reinforcement bracket is positioned between the inner door frame and the outer door frame, the inner door frame defining an aperture through which the fastener passes to join the outer door frame, the reinforcement bracket, and the inner door frame.

2. The washing machine appliance of claim 1, wherein the outer door frame and the inner door frame are substantially circular and define a center opening, the door assembly further comprising:

a window positioned between the outer door frame and the inner door frame and within the center opening.

3. The washing machine appliance of claim 1, wherein an inner diameter of the boss greater than or equal to an outer diameter of the expandable sleeve when the mechanical fastener is not installed.

4. The washing machine appliance of claim 1, wherein the reinforcement bracket further comprises:

a protrusion that extends outward along a radial direction from the expandable sleeve, wherein the boss defines a complementary slot for receiving the protrusion to secure the reinforcement bracket to the outer door frame.

5. The washing machine appliance of claim 1, wherein the outer door frame defines an alignment aperture and the reinforcement bracket defines an alignment feature for receipt within the alignment aperture.

6. The washing machine appliance of claim 1, wherein the outer door frame defines a plurality of bosses and the reinforcement bracket defines a plurality of expandable sleeves for receipt within the plurality of bosses.

7. The washing machine appliance of claim 1, wherein the reinforcement bracket is a hinge bracket configured for receiving a door hinge.

8. The washing machine appliance of claim 1, wherein the reinforcement bracket is a handle frame.

9. The washing machine appliance of claim 1, wherein the door assembly comprises two reinforcement brackets positioned on opposite lateral sides of the outer door frame, each of the two reinforcement brackets having symmetrically positioned expandable sleeves.

10. The washing machine appliance of claim 1, wherein the mechanical fastener is a self-threading screw.

11. The washing machine appliance of claim 1, wherein the boss, the expandable sleeve, and the mechanical fastener extend substantially along the transverse direction.

12. The washing machine appliance of claim 1, further comprising:

an appearance piece attached to a front of the outer door frame and the reinforcement bracket.

13. The washing machine appliance of claim 1, wherein the reinforcement bracket is formed from polypropylene.

14. The washing machine appliance of claim 1, wherein the reinforcement bracket comprises polypropylene and fiberglass reinforcement.

* * * * *